United States Patent [19]

Söderberg

[11] 4,227,275

[45] Oct. 14, 1980

[54] METHOD AND APPARATUS FOR ALIGNING AND STAPLING SHEETS OF PAPER

[75] Inventor: Terje Söderberg, Farsta, Sweden

[73] Assignee: Guternic AB, Stockholm, Sweden

[21] Appl. No.: 954,985

[22] Filed: Oct. 26, 1978

[30] Foreign Application Priority Data

Nov. 11, 1977 [SE] Sweden ..... 7712798

[51] Int. Cl.[3] ..... B27F 7/17

[52] U.S. Cl. ..... 11/1 R; 227/44; 227/100; 271/210; 271/213

[58] Field of Search ..... 270/53; 271/210, 213, 271/221, 222; 11/1 R; 227/39, 40, 44, 99, 100

[56] References Cited

U.S. PATENT DOCUMENTS

| | | | |
|---|---|---|---|
| 3,053,531 | 9/1962 | Green et al. | 227/100 |
| 3,222,060 | 12/1965 | Svantesson | 271/210 |
| 3,502,255 | 3/1970 | Hermann et al. | 227/44 |
| 3,972,525 | 8/1976 | Foster et al. | 271/221 |
| 3,994,427 | 11/1976 | Gawatsiou | 227/100 |

*Primary Examiner*—John McQuade

*Attorney, Agent, or Firm*—Merchant, Gould, Smith, Edell, Welter & Schmidt

[57] ABSTRACT

A method and a device for automatically arranging individual paper sheets in a set of papers with the edges of said paper sheets in alignment with each other in combination with stapling said set of papers. A set of papers having unaligned edges is positioned on a lower edge of a vibrating table and the papers are joggled so that one edge of the paper sheets in the set of papers become aligned. The set of papers is thereafter urged against a lateral edge of the table while being vibrated, whereby all edges of the paper sheets become evenly aligned. In this final phase a stapler staples the set of papers together.

4 Claims, 4 Drawing Figures

METHOD AND APPARATUS FOR ALIGNING AND STAPLING SHEETS OF PAPER

BACKGROUND OF THE INVENTION

1. Field of the Invention

This invention refers to a method and a device for automatically aligning the edges of individual paper sheets in a set of papers with respect to each other in combination with stapling said set of papers.

More specifically the invention refers to a method and a device for automatically vibrating a set of papers and feeding the individual paper sheets in it together laterally, whereupon the paper sheets in the set of papers are stapled together and the stapled set of papers is discharged.

2. Description of the Prior Art

Stapling paper by means of staplers of various types is a well-known concept. The staplers may be manual, both large and small, and in their operation a staple is forced through a number of paper sheets by handpower. In addition, there are electric staplers which resemble the manual ones but in which the handpower has been replaced by the force of an electric magnet or by motor power. A third type of staplers are the ones which do not operate with completed staples in a magazine and which instead first fabricate the staple of a metal wire and thereafter staple the paper sheets together. These latter devices are often designated as wire stapling devices.

Prior to a set of papers being stapled it has to be pretreated —joggled—so that the edges of the individual paper sheets in the set will become located exactly along each other, i.e., will have their edges aligned with respect to each other. In the case of manual stapling the procedure in this respect is such, that two or more paper sheets are joggled manually against a table or in a joggling machine so that the paper sets become even along their sides, whereafter the set of papers is pushed manually into the stapler, whereupon the staple is forced through the paper sheets. In automatic collating machines mechanical arms, wheels or angle members are utilized to push or displace the paper sheets so that they become arranged in a predetermined order. Thereafter the paper sheets are stapled by means of an appropriate stapler.

SUMMARY OF THE INVENTION

The present invention has the object of providing a method and a device for joggling paper sheets in sets of paper in combination with stapling. The relevant device is of very simple and reliable design and it comprises a continuously vibrating shaker table which serves as a joggling machine and which in consequence of its continuously vibrating the sheets of paper simultaneously decreases the friction between the individual paper sheets and between the set of papers and the table, respectively. Said shaker table can for example be provided with a feed belt which conducts the paper sheets into the stapler. The means by which the desired object is achieved are disclosed by the accompanying claims.

BRIEF DESCRIPTION OF THE DRAWINGS

An example of an embodiment of a device in accordance with the invention is illustrated in the accompanying drawings, in which.

DESCRIPTION OF THE PREFERRED EMBODIMENT

Figure 1:
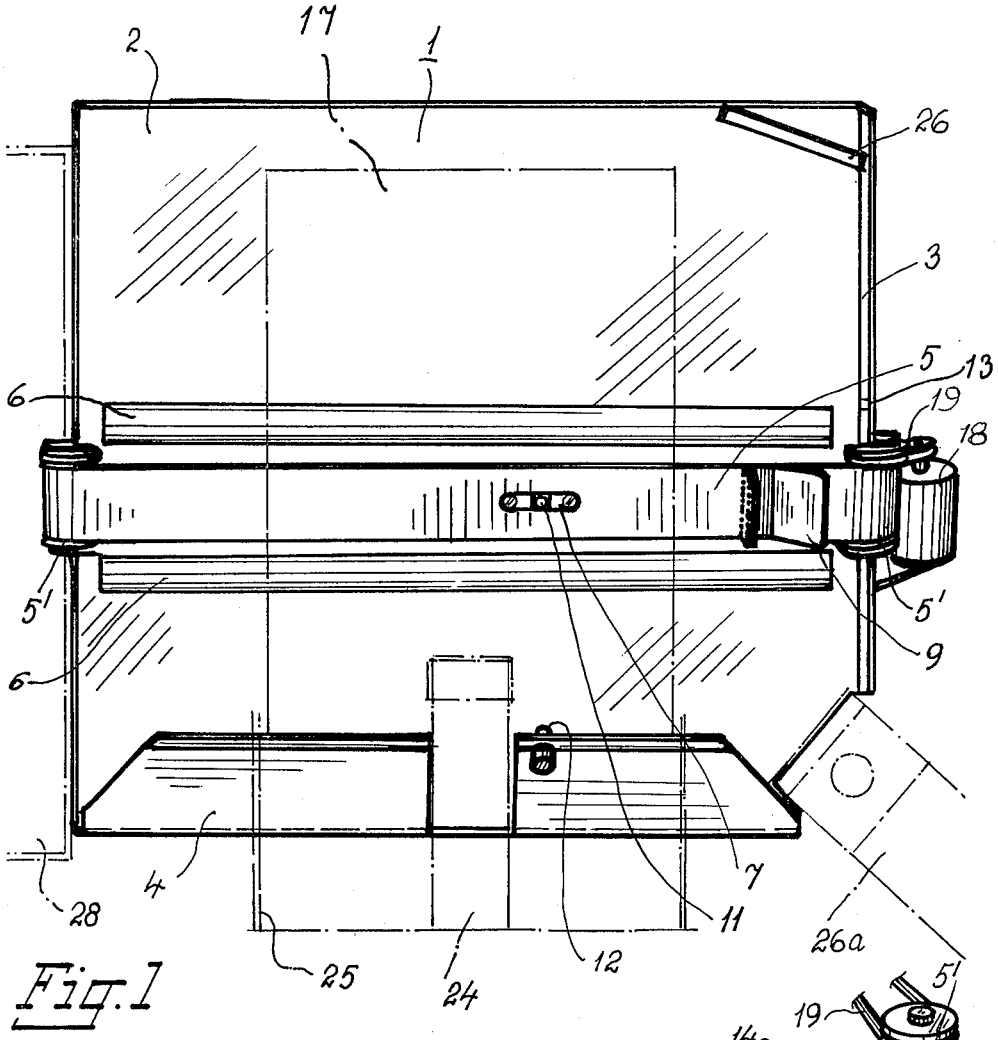
FIG. 1 shows a perspective view of a device according to the invention.

FIG. 1 shows a shaker table 1 which in the illustrated embodiment is composed of a base plate 2 having one or two angularly bent edges, namely the edge 3 on the right side of the plate and the edge 4 at the lower part of the plate. The table 1 may appropriately form an angle of between approximately 45° and approximately 90° to the horizontal plane.

An endless feed belt 5 runs around two rollers 5' which are located at opposing edges of the table 1. Said belt 5 can be driven in two directions by means of a reversible drive motor 18. The feed belt 5 is shown more in detail in a perspective view in FIG. 2, in which it may be seen that the belt is provided with two slits 7 and 8 as well as with two dog and push members 9 and 10, respectively. The slits 7 and 8 form openings for light access to a photocell 11 (FIG. 1) which is disposed on the underneath side of the table 1 and which is illuminated by a lamp 12. The distances between said slits in the longitudinal direction of the belt are substantially equal, counted in one and the other direction, respectively, of the belt. This is also the case of the dog and push members, which, however, are not located exactly in the middle between the slits 7 and 8 and whose positions are adapted to the position of the photocell and the side edge 3 of the table 1, respectively, as well as to the size of the paper sheets to be collated. When one of the slits, for example 7, and one of the dog and push members, for example 9, are located at the front side of the table 1 the other slit and the other dog and push member 10, respectively, will be located behind said table.

Figure 3:
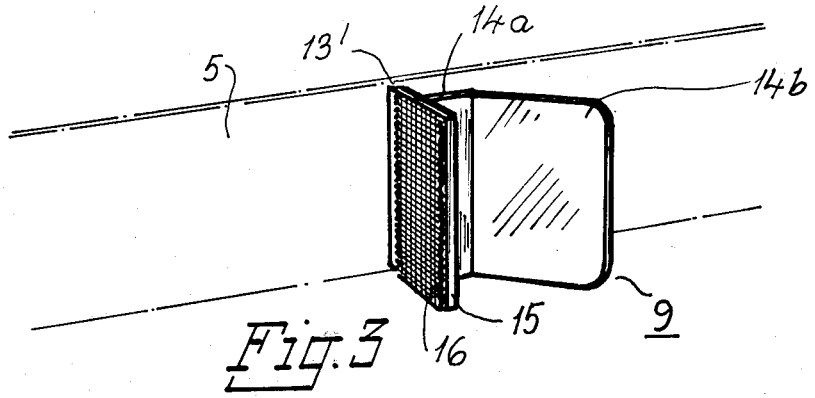
FIG. 3 shows a detailed enlargement of a device for bringing paper sheets together and for feedout, respectively, said device being placed on the feed belt of the invention.

One of the dog and push members 9 is shown as viewed from one end and more in detail in FIG. 3, with the belt 5 being designated by dot-dash lines. The member 9 is attached to the belt 5 by means of the edge 13' of a vertical portion 15, which to advantage may be provided with a rubber lining 16 on one side. If desired, a section **14*a* parallel to the belt may extend in the opposite direction from the vertical portion 15 as compared to the rubber lining, with the distance of said section 14*a* from the belt being determined by the maximum thickness of the sets of paper which are to be joggled. The section 14*a* may subsequently merge into a section 14*b* which forms an angle of less than 90° to the belt 5**, for example 30°.

Figure 4:
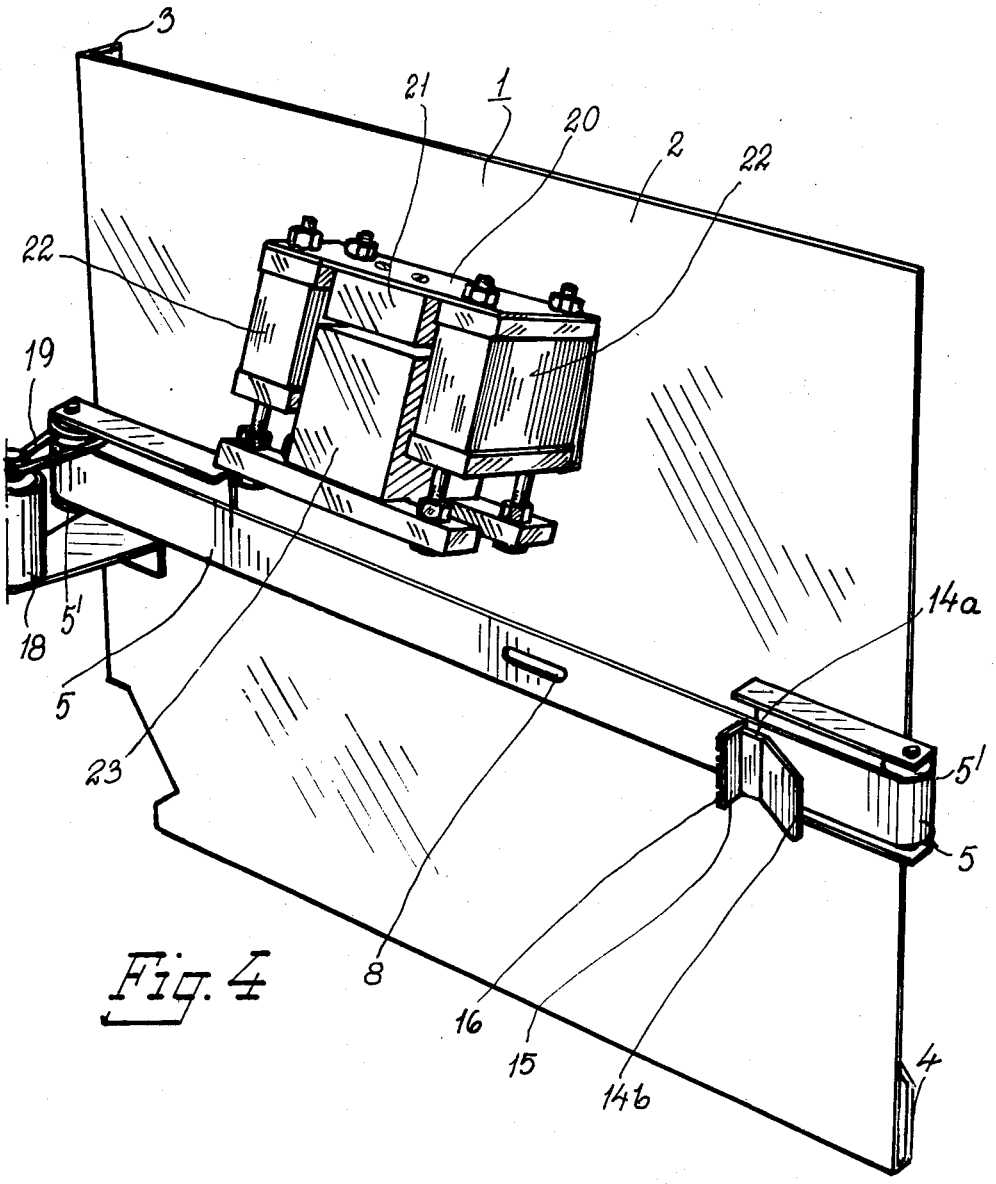
FIG. 4 shows a perspective view of the device of the invention as viewed from the side rear. The same reference numerals have been utilized in the various figures wherever this has been possible.

FIG. 4 shows the device of the invention illustrated from the rear, wherein the belt 5 and the reversible drive motor 18 may be seen, wherein said motor may be of a type known per se for driving one of the belt mounting and drive rollers 5' by means of a drive belt 19.

In order that the table 1 may be made to vibrate an attachment 20 is disposed on its rear side, said attachment being provided with a magneto armature 21 and being disposed in appropriate manner with respect to an electromagnet 23 by means of rubber buffers. When an alternating current is supplied to the electromagnet the vibrating table will be made to vibrate in consequence of the electromagnet 23 attacting the armature and releasing the same, respectively, at an even rate, with adjustment means being provided for example in the form of bolts between the rubber buffers 22 and the carrier of electromagnet 23 so that the amplitude of the vibrations of the shaker table 1 may be set as desired.

The device disclosed by the invention can be fed manually or it can cooperate with for example a belt conveyor 24 (FIG. 1) which runs in a paper feed channel 25.

Furthermore, a stapler 26 of any appropriate type disposed in accordance with FIG. 1 or at any other appropriate angle with regard to the table 1 may be utilized.

The device of the invention which is shown as an example operates in the following manner.

Individual paper sheets which are intended to be joggled and thereafter to be stapled together and subsequently to be discharged to a collecting position are first fed forward in the channel 25 by means of the belt 24 so as to become disposed upon each other in the set of papers 17, wherein said paper sheets will be retained on the table by their lower edges engaging the upwardly bent edge 4 of the table. Naturally it would be possible alternatively to place a set of papers 17 on the table 1 manually.

Figure 2:
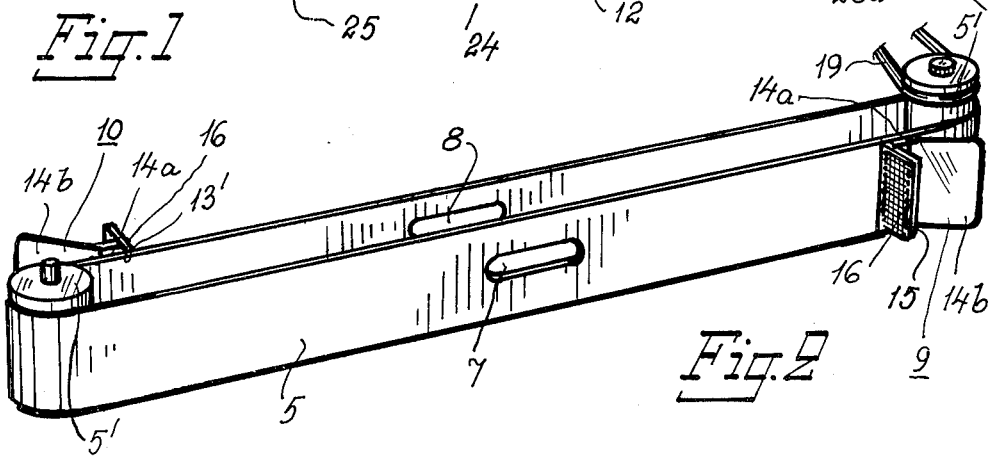
FIG. 2 shows a perspective view of the feed belt included in the device of FIG. 1.

When a predetermined time has lapsed after the first paper sheet has been conveyed up on the table 1, said time being determined by the paper sheets shielding the photocell 11 or a microswitch or some other appropriate control member, which as indicated above previously has been capable of being illuminated by light from the lamp 12 through the slit 7 of the belt 5 or has been capable of being actuated in other manner, the motor 18 will be actuated so as to drive the front side of the belt 5 to the right as viewed in FIG. 1, wherein the dog and push member 10, which is illustrated at the rear side of the belt in FIG. 2, will be conveyed onto the front side of the table 1 and will be displaced to the right, with the set of papers following along under its section **14*a* when the edge 13' (FIG. 3), i.e. the part of the vertical portion 15 of the member which is attached to the belt 5, reaches the left edge of the set of papers 17. The entire set of papers will thereby be conveyed to the right until it strikes the right edge 3 of the table. The table 1 has vibrated during this whole time through the influence of the electromagnet 23 on its rear side, and this vibration will continue, resulting in joggling of the set of papers, as two of the edges of the set of papers engage the respective edges 3 and 4 of the table 1 simultaneously with the edge 13' of the dog and push member urging the set of papers against the edge 3 of the table 1. In order to bring the individual paper sheets of the set of papers together additionally a guide angle 26 is disposed at the upper corner of the table 1 in the manner illustrated in FIG. 1**.

Simultaneously with the right edge of the set of papers having reached the edge 3 of the table 1 a microswitch 13 will be actuated, which in its turn on one hand actuates the stapler **26*a* in the lower right corner of FIG. 1 so that the set of papers will be stapled and on the other hand causes motor 18 to reverse its direction of rotation so that the stapled set of papers is conveyed to the left and thus is conveyed away from the table 1 by the rubber lining 16 of the other dog and push member 9 and is discharged downwardly into a diagrammatically shown collection receptacle 28**. If desired, this receptacle can of course be replaced by a conveyor belt which conveys the stapled sets of paper to a centrally located collecting station.

In order to prevent the lowermost paper sheet in the set of papers 17 from "sticking" to the belt so as to be conveyed to the right with the belt when the belt moves, whereas the other paper sheets are not conveyed to the right until they are intercepted by the dog and push member 10, the table 1 may to advantage be provided with two elongated bars 6 having rounded profiles and being parallel to the lower edge 4 of the table so that said lowermost paper is raised a slight distance from the belt. Because of said bars 6 the friction between the lowermost paper sheet and the table is also reduced, whereby both the joggling and conveying to the right (in accordance with FIG. 1) are facilitated.

The invention is not restricted to the embodiment described above and illustrated in the drawings, and this embodiment merely comprises an example of the invention and the mode in which it is applied.

I claim:

1. A device for automatically arranging individual paper sheets in a set of papers with the edges of said paper sheets in alignment with each other in combination with stapling said set of papers, said device comprising:

(a) a paper-receiving table, said table having a lower engagement edge and a lateral engagement edge;

(b) means for vibrating said table;

(c) a belt member;

(d) a motor, said motor being adapted to drive said belt member for conveying it over said table parallel to said lower engagement edge and at right angles to a lateral engagement edge;

(e) a pusher member affixed to said belt member, said pusher member comprising a portion of a first dog member adapted to urge the set of papers against the lateral engagement edge of said table when said belt member is driven by said motor;

(f) a stapler, located to receive and staple said set of papers after their edges have been aligned in the final phase of operation of said pusher member;

(g) switch means disposed in said lateral engagement edge for sensing the engagement of said set of papers with said engagement edge and causing said motor to reverse direction; and (h) an engagement member, said engagement member comprising a portion of a second dog member adapted to convey the stapled set of papers away from the table for discharging the same when said motor is reversed.

2. A device in accordance with claim 1, wherein said vibrating means includes a magnetic vibrator coupled to said table for making the table vibrate continuously.

3. A device in accordance with claim 1, wherein said dog members are provided with a bent portion forming an angle with said belt member.

4. A method of automatically arranging and stapling paper sheets into a set of papers with the edges of said paper sheets in alignment with each other comprising the steps of:

(a) conveying a set of papers in a first direction onto a vibrating table into contact with a first engaging edge such that the edges of said set of papers become aligned along said first edge;

(b) conveying said set of papers in a second direction perpendicular to said first direction so that said set of papers are conveyed toward a second engaging edge by a pusher member whereby all edges of said set of paper become evenly aligned;

(c) sensing the engagement of said set of papers with said second engaging edge;

(d) stapling said set of papers; and (e) discharging said set of papers from said table by pushing said stapled set of papers in a direction opposite said second direction.

* * * * *